US010500705B2

(12) United States Patent
French

(10) Patent No.: US 10,500,705 B2
(45) Date of Patent: Dec. 10, 2019

(54) FASTENER HOLDER AND DISPENSER

(71) Applicant: Chad A. French, Midland, MI (US)

(72) Inventor: Chad A. French, Midland, MI (US)

( * ) Notice: Subject to any disclaimer, the term of this patent is extended or adjusted under 35 U.S.C. 154(b) by 0 days.

(21) Appl. No.: 15/946,808

(22) Filed: Apr. 6, 2018

(65) Prior Publication Data

US 2018/0290281 A1 Oct. 11, 2018

Related U.S. Application Data

(60) Provisional application No. 62/482,980, filed on Apr. 7, 2017.

(51) Int. Cl.

| | |
|---|---|
| ***B25C 5/16*** | (2006.01) |
| ***B25C 3/00*** | (2006.01) |
| *B27F 7/38* | (2006.01) |

(52) U.S. Cl.

CPC ..... *B25C 5/1634* (2013.01); *B25C 3/00* (2013.01); *B25C 5/1658* (2013.01); *B25C 5/1668* (2013.01); *B27F 7/38* (2013.01)

(58) Field of Classification Search

CPC ... B25C 5/1634; B25C 5/1658; B25C 5/1668; B25C 3/00; B27F 7/38

USPC ..... 206/340; 227/120, 121, 123, 125

See application file for complete search history.

(56) References Cited

U.S. PATENT DOCUMENTS

| | | | | | |
|---|---|---|---|---|---|
| 210,748 | A | | 12/1878 | Brown | |
| 483,374 | A | | 9/1892 | Brown | |
| 491,235 | A | | 2/1893 | Brown | |
| 514,699 | A | | 2/1894 | Brown | |
| 1,557,121 | A | * | 10/1925 | Vogel | B65D 69/00 206/340 |
| 1,827,315 | A | * | 10/1931 | Hallen | B25C 5/1637 206/340 |
| 2,127,665 | A | * | 8/1938 | Leslie | F16L 3/04 206/341 |
| 2,436,577 | A | | 12/1945 | Kirby | |
| 2,501,564 | A | | 3/1950 | Goodstein | |
| 2,667,638 | A | | 2/1954 | Segal | |
| 3,191,802 | A | | 6/1965 | Lasting | |
| 3,278,107 | A | * | 10/1966 | Rygg | A61B 17/0686 206/340 |
| 4,243,168 | A | * | 1/1981 | Balma | B25C 5/025 227/109 |
| 4,353,481 | A | * | 10/1982 | Tando | H05K 13/0084 206/499 |
| 4,378,065 | A | | 3/1983 | Smirne | |
| 4,485,531 | A | * | 12/1984 | Murphy | F16B 21/086 206/344 |
| 4,530,445 | A | | 7/1985 | Decker | |

(Continued)

FOREIGN PATENT DOCUMENTS

| | | |
|---|---|---|
| GB | 2 366791 A | 3/2002 |
| JP | A-2011-218534 | 11/2011 |

*Primary Examiner* — Patrick D Hawn

(74) *Attorney, Agent, or Firm* — Nixon & Vanderhye, P.C.

(57) ABSTRACT

A holding and dispensing device may conveniently store fasteners and permits a user to easily and quickly retrieve and dispense fasteners, such as staples, one at a time, without the risk of fasteners falling out of the device, or protruding in a manner that may harm the user. Embodiments may be especially suitable for a core of staples. The present disclosure further relates to methods of holding fasteners in a fastener holder and methods of dispensing fasteners.

16 Claims, 22 Drawing Sheets

(56) References Cited

U.S. PATENT DOCUMENTS

| | | | | | |
|---|---|---|---|---|---|
| 4,553,190 | A | * | 11/1985 | Mueller | H01L 23/60 206/718 |
| 4,614,291 | A | | 9/1986 | Monacelli | |
| 4,635,794 | A | | 1/1987 | Lemmer | |
| 4,706,812 | A | * | 11/1987 | Spinelli | H05K 13/0084 206/338 |
| 4,795,073 | A | * | 1/1989 | Yamamoto | B25C 5/025 227/120 |
| 4,979,615 | A | | 12/1990 | Duncan | |
| 5,038,992 | A | * | 8/1991 | Shiang | B25C 5/025 227/120 |
| 5,139,167 | A | * | 8/1992 | McCarthy | B65D 83/10 206/354 |
| 5,244,139 | A | * | 9/1993 | Joyce | B25C 5/1606 206/340 |
| 5,651,464 | A | * | 7/1997 | Weber | B65D 5/5007 206/718 |
| 6,595,399 | B1 | * | 7/2003 | Cassese | B25C 1/006 227/113 |
| 9,352,894 | B2 | | 5/2016 | Brzon et al. | |
| 9,586,334 | B2 | * | 3/2017 | Sugihara | B27F 7/38 |
| 10,259,642 | B2 | * | 4/2019 | Wonderley | B65D 83/10 |
| 2004/0206647 | A1 | | 10/2004 | Skelton | |
| 2008/0149682 | A1 | * | 6/2008 | Uhm | B25C 5/1606 227/120 |
| 2010/0193563 | A1 | * | 8/2010 | Haramiishi | B27F 7/38 227/120 |
| 2012/0111750 | A1 | | 5/2012 | Phillips | |

* cited by examiner

FASTENER HOLDER AND DISPENSER

RELATED APPLICATION

This application claims priority to U.S. Provisional Patent Application No. 62/482,980, filed Apr. 7, 2017, and incorporated by reference in its entirety.

FIELD

The present disclosure relates to a device for holding and dispensing fasteners, such as staples, methods of holding fasteners in a fastener holder, and methods of dispensing fasteners.

BACKGROUND

Workers in the electrical industry have struggled with developing methods of conveniently storing and retrieving fasteners for the installation of electrical wire. Fasteners used for installation of electrical wire, such as staples, are generally uncohered and, prior to use, are typically stored loose in a pouch on an apron tied around the installer's waist. These fasteners typically have very sharp points, which can cause discomfort and bleeding when they poke the user's fingers. Also, they become tangled together or with other items, and are difficult to extract one at a time. The fasteners may fall on the floor and are difficult to retrieve and may be wasted. Devices disclosed in the prior art, such as the dispenser in U.S. Pat. No. 2,436,577, are configured for use only with uncohered stapled and teach elements, such as cam 36 (which is required to prevent accidental or unintentional displacement of the staples), that make retrieval of staples more cumbersome. Such devices suffer from numerous deficiencies, ranging from inconsistent fastener loading, fastener jamming, and difficult fastener extraction. Hence, devices for more convenient storage, retrieval, and dispensing of fasteners are needed.

SUMMARY

It is an object of this disclosure to provide a holding and dispensing device that conveniently stores fasteners and which permits a user to easily and quickly retrieve and dispense fasteners one at a time, without the risk of being poked. The present disclosure further relates to methods of holding fasteners in a fastener holder and methods of dispensing fasteners.

Embodiments of the present approach may take the form of a fastener holder and dispenser, the fastener holder and dispenser having a front wall, a back wall, two opposing side walls, an open top wall, and a partially open bottom wall such that, when assembled, form an elongated housing having a height along a y-axis, a width along an x-axis, and a thickness along a z-axis. For orientation purposes, the front wall and back wall are configured to extend along an x-y plane, such that the opposing side walls are configured to extend along a y-z plane. The open top wall and the partially open bottom wall are configured to extend along an x-z plane. Embodiments may include a fastener rail extends the length of the elongated housing, the fastener rail being fixedly attached to an inside surface of the back wall and being shaped at a front to conform to the shape of the fasteners. The front wall defines a dispensing slot at the bottom of the front wall. The fastener holder and dispenser may include at least one magnet affixed to the partially open bottom wall. It should be appreciated that the magnets may be located elsewhere. The present approach therefore allows for the containment of a plurality of fastener devices, such as a core of staples. The magnets may be used to position the fastener devices in the desired position, and retain to prevent a fastener from easily falling out of the housing. However, a user may exert force sufficient to overcome the magnetic force and remove a fastener from the housing.

Some embodiments may include a belt clip, which may be, for example, affixed to the back wall. In some embodiments, the front wall comprises a window therein for viewing supply of the fasteners. The top wall in some embodiments of the present approach may be configured to receive a fastener core. For example, the top wall may include an opening in the shape of, e.g., the general outline of, the fastener core. In some embodiments the fastener holder and dispenser comprises two magnets affixed to opposing ends of the bottom wall.

In some embodiments, a magnet may be configured to engage a lead fastener of the fastener core upon contact. For example, the magnet may be positioned at or near the dispensing slot to attract the fastener at the bottom of the core. The dispensing slot in some embodiments may be configured to reveal one fastener at a time. For some embodiments, the dispensing slot may be configured to reveal a crown of the fastener, wherein the crown faces outward. This configuration may be especially advantageous for staple cores, in which the barbed end is preferentially facing inward to as to prevent harm to users. In some embodiments, the fastener rail may be tapered such that it is narrower at the section nearest the top wall and wider at the section nearest the bottom wall.

The present approach may also take the form of a method of holding fasteners in a fastener holder and dispenser. Embodiments may include providing a front wall, a back wall, two opposing side walls, an open top wall, and a partially open bottom wall such that, when assembled, form an elongated housing having a height along a y-axis, a width along an x-axis, and a thickness along a z-axis. The front wall and back wall may be configured to extend along an x-y plane, the opposing side walls may be configured to extend along a y-z plane, and the open top wall and the partially open bottom wall may be configured to extend along an x-z plane.

In some embodiments, a fastener rail extends the length of the elongated housing. The fastener rail may be fixedly attached to an inside surface of the back wall, and in some embodiments and shaped at a front to conform to the shape of the fasteners. The front wall defines a dispensing slot at the bottom of the front wall, and the fastener holder and dispenser comprises at least one magnet affixed to the partially open bottom wall. A fastener core may be placed through the open top wall into the elongated housing. Under the present approach, the fastener holder and dispenser may have at least one magnet affixed to the partially open bottom wall, and a fastener may be removed by placing a fastener core through the open top wall into the elongated housing, and then inserting a finger into the partially open bottom wall and pulling a fastener out through the dispensing slot. It should be appreciated that deviations from the disclosed embodiments may be made without departing from the present approach.

DESCRIPTION

The following description illustrates embodiments of the present approach in sufficient detail to enable practice of the present approach. Although the present approach is described with reference to these specific embodiments, it should be appreciated that the present approach can be embodied in different forms, and this description should not be construed as limiting any appended claims to the specific embodiments set forth herein. Rather, these embodiments are provided so that this disclosure will be thorough and complete, and will fully convey the scope of the present approach to those skilled in the art.

The terminology used in the description of the present approach herein is for the purpose of describing particular embodiments only and is not intended to be limiting of the present approach. As used in the description of the present approach and the appended claims, the singular forms "a," "an" and "the" are intended to include the plural forms as well, unless the context clearly indicates otherwise. The present approach includes numerous alternatives, modifications, and equivalents as will become apparent from consideration of the following detailed description.

Figure 1:
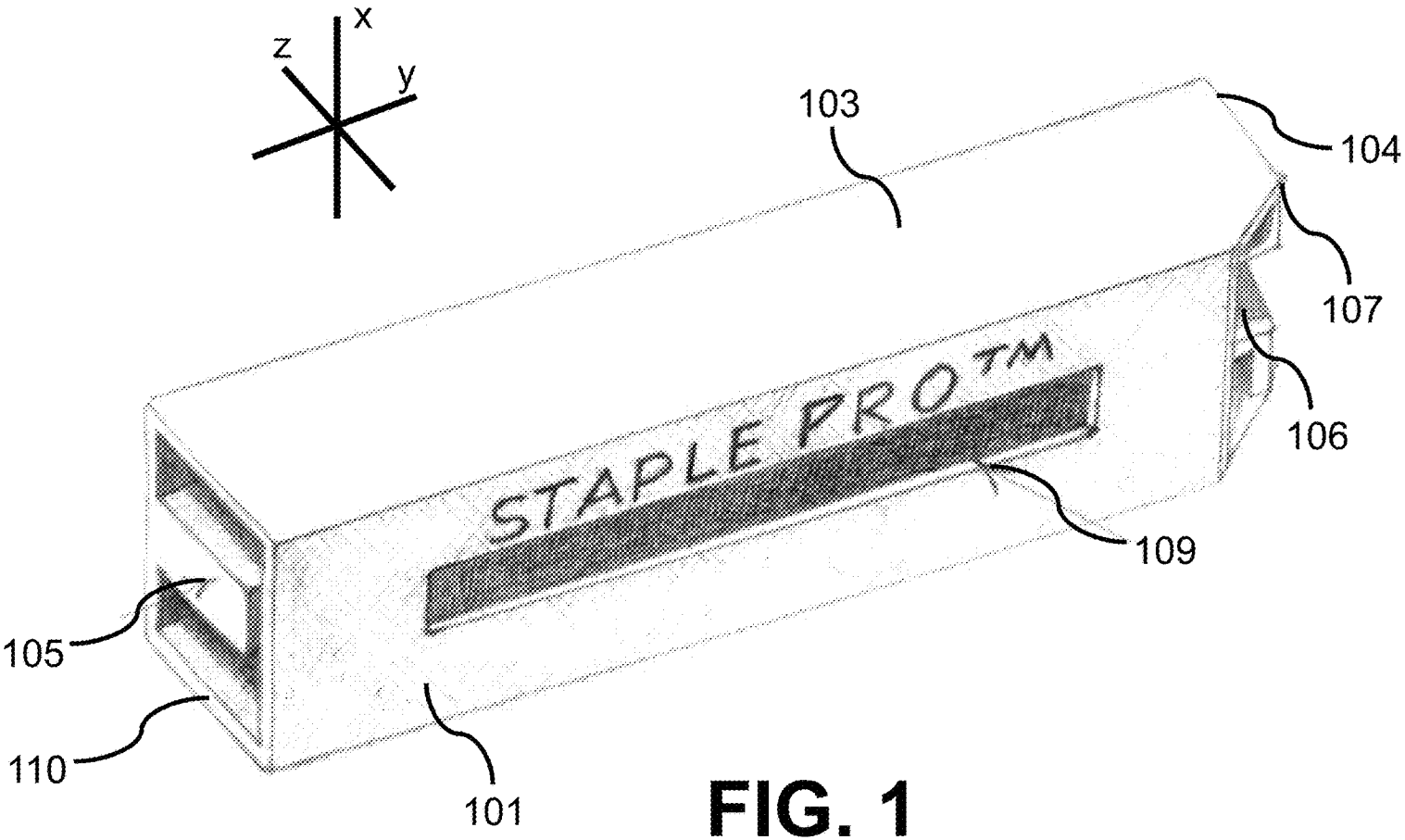
FIG. 1 is a front left perspective view of the fastener holder and dispenser with reference axes shown and labeled.
Figure 2:
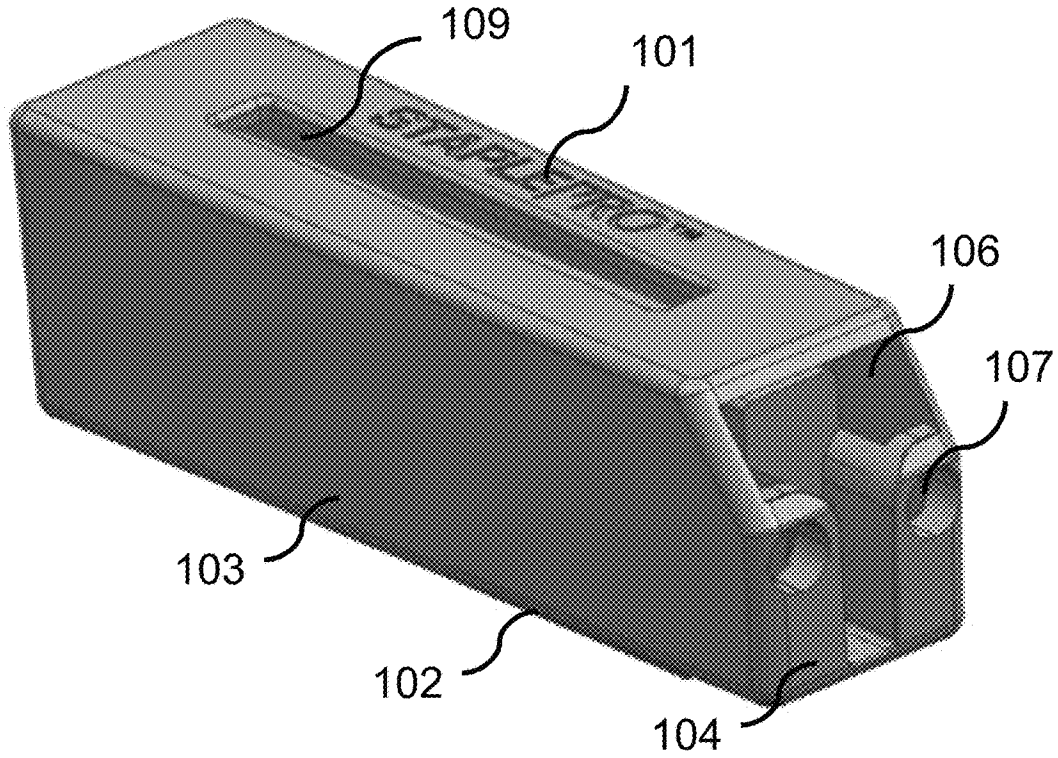
FIG. 2 is a side left perspective view of the fastener holder and dispenser with reference axes shown and labeled.
Figure 9:
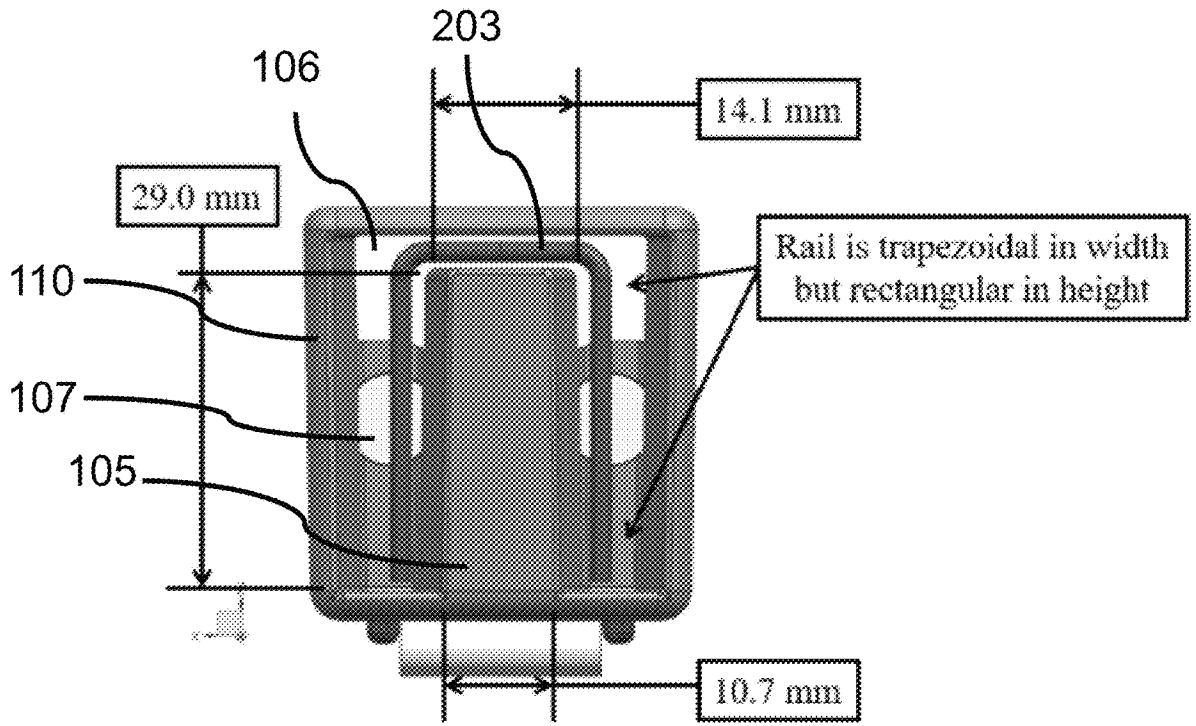
FIG. 9 is a top plan view of the fastener holder and dispenser with certain dimensions of the fastener holder and dispenser.
Figure 17B:
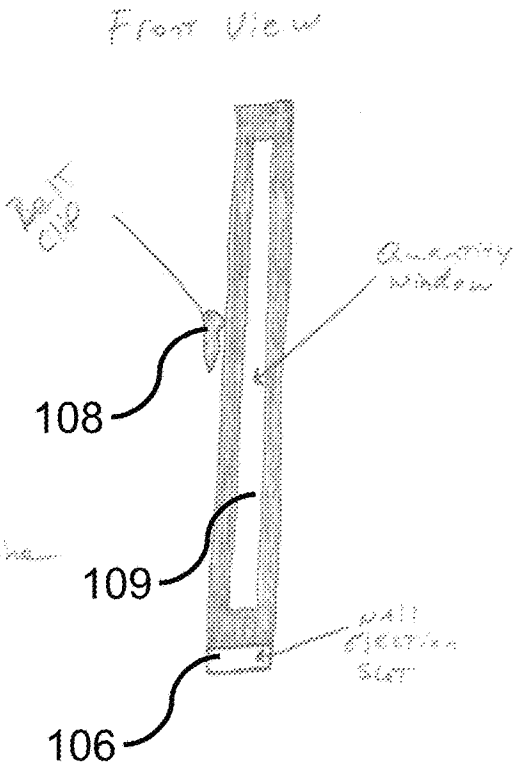
FIG. 17A-B provide a side and front plan view of a fastener holder and dispenser that is configured to hold and dispense nails.
Figure 17A:
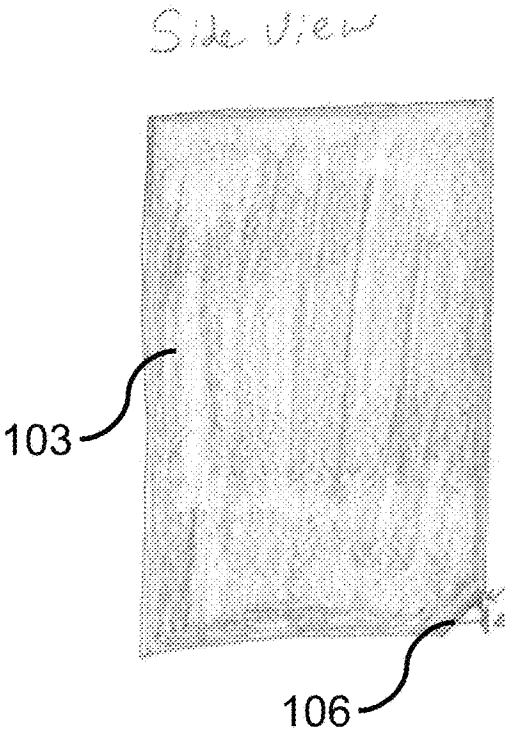
Figure 18A:
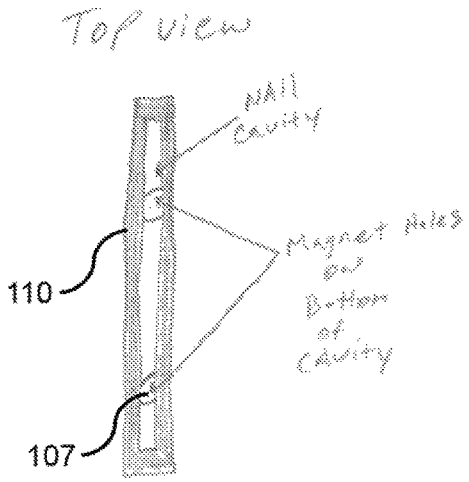
FIG. 18A-B provide a top and bottom plan view of a fastener holder and dispenser that is configured to hold and dispense nails.
Figure 18B:
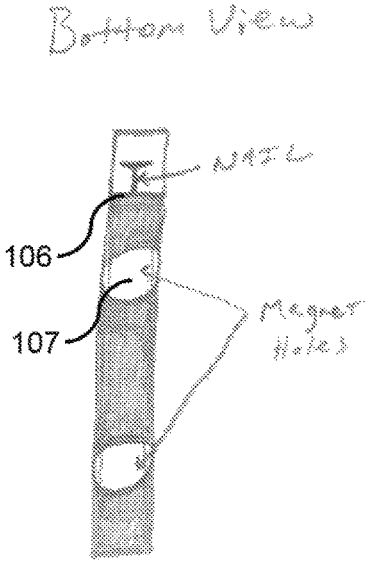

Described herein are embodiments of a holding and dispensing device that stores fasteners, such as staples or nails, and which permits a user to easily and quickly retrieve and dispense fasteners. As distinct from tools meant to install fasteners such as staples and nails, the current invention presents the crown or head of the fastener for user extraction, rather than the point of the fastener for user installation. Embodiments of the holder and dispenser may include a front wall 101, a back wall 102, two opposing side walls 103, an open top wall 110, and a partially open bottom wall 104 that, when assembled, form an elongated housing having a height along a y-axis, a width along an x-axis, and a length along a z-axis, as is shown in FIG. 1 and FIG. 2. Walls shown in FIG. 1 are portrayed as generally continuous surfaces connected at edges of the device, but it should be appreciated that one or more walls may be discontinuous along a portion of its length and/or width, and in some embodiments walls may connect at less than the entire length of an edge. It should be appreciated that in some embodiments, two walls may connect at one or more locations other than an edge, such as at or near bottom wall 104 and/or top wall 110. The front wall 101 and back wall 102 in the FIG. 1 embodiment are configured to extend along an x-y plane, the two opposing side walls 103 are configured to extend along a y-z plane, and the open top wall 110 and the partially open bottom wall 104 are configured to extend along an x-z plane, as is shown in FIG. 2. In the embodiment shown, a fastener rail 105 extends substantially the length of the elongated housing, is fixedly attached to an inside surface of the back wall 102, and is shaped at a front to conform to the shape of the fastener, such as staples, as is shown in FIG. 9. It should be appreciated that the fastener rail 105 may extend the entire length of the elongated housing or extend less than substantially the full length of the elongated housing in other embodiments. It should also be appreciated that the shape of the fastener rail 105 and the dispensing slot 106 can be modified to use with different types of fastener. For example, although several embodiments are described relating to a staple, FIG. 17 and FIG. 18 illustrate embodiments of a fastener holder and dispenser according to the present approach in which the fastener is a nail.

Figure 6:
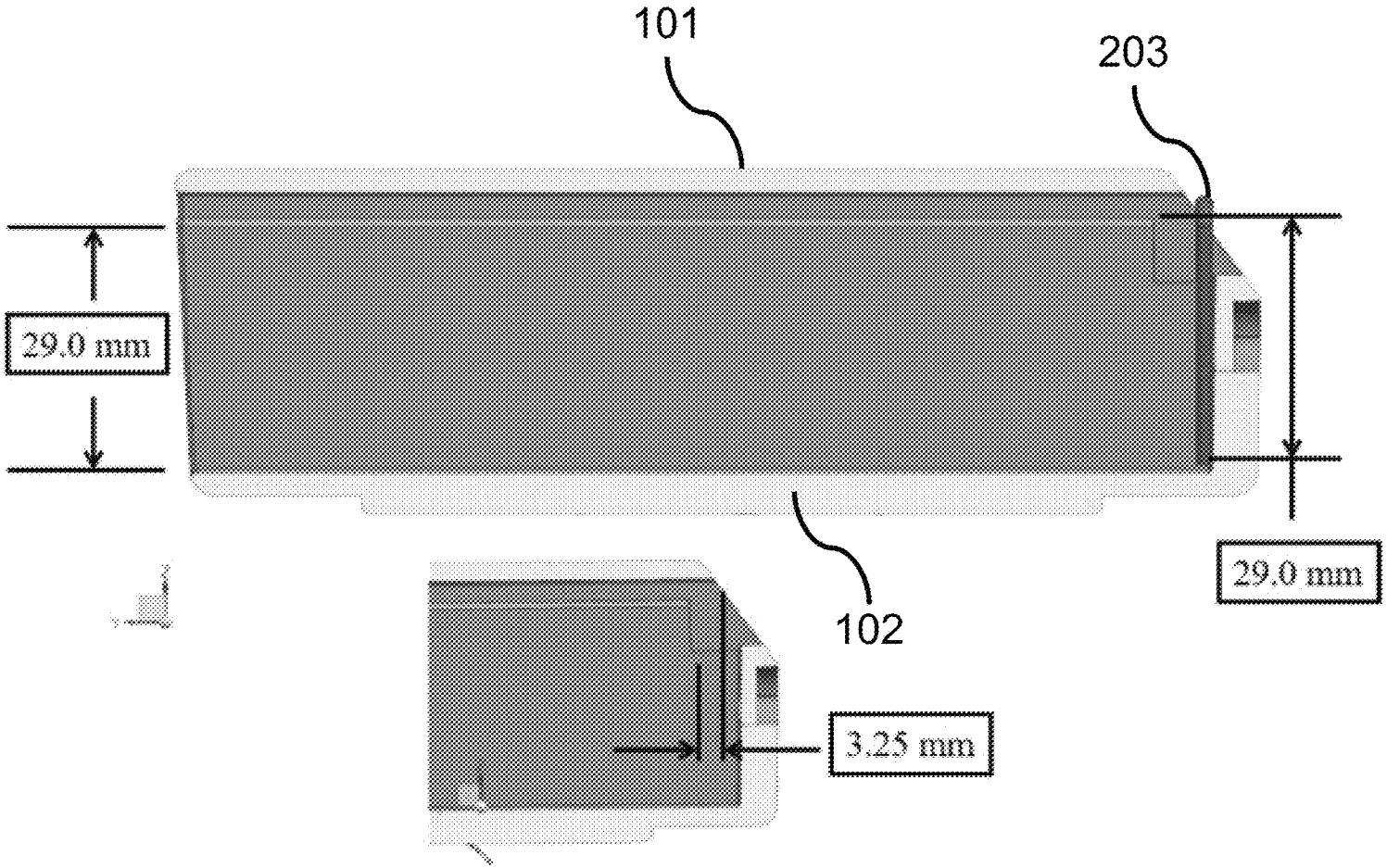
FIG. 6 is a side plan view of the fastener holder and dispenser with reference axes shown and labeled that shows certain dimensions of the fastener rail of the fastener holder and dispenser.
Figure 7:
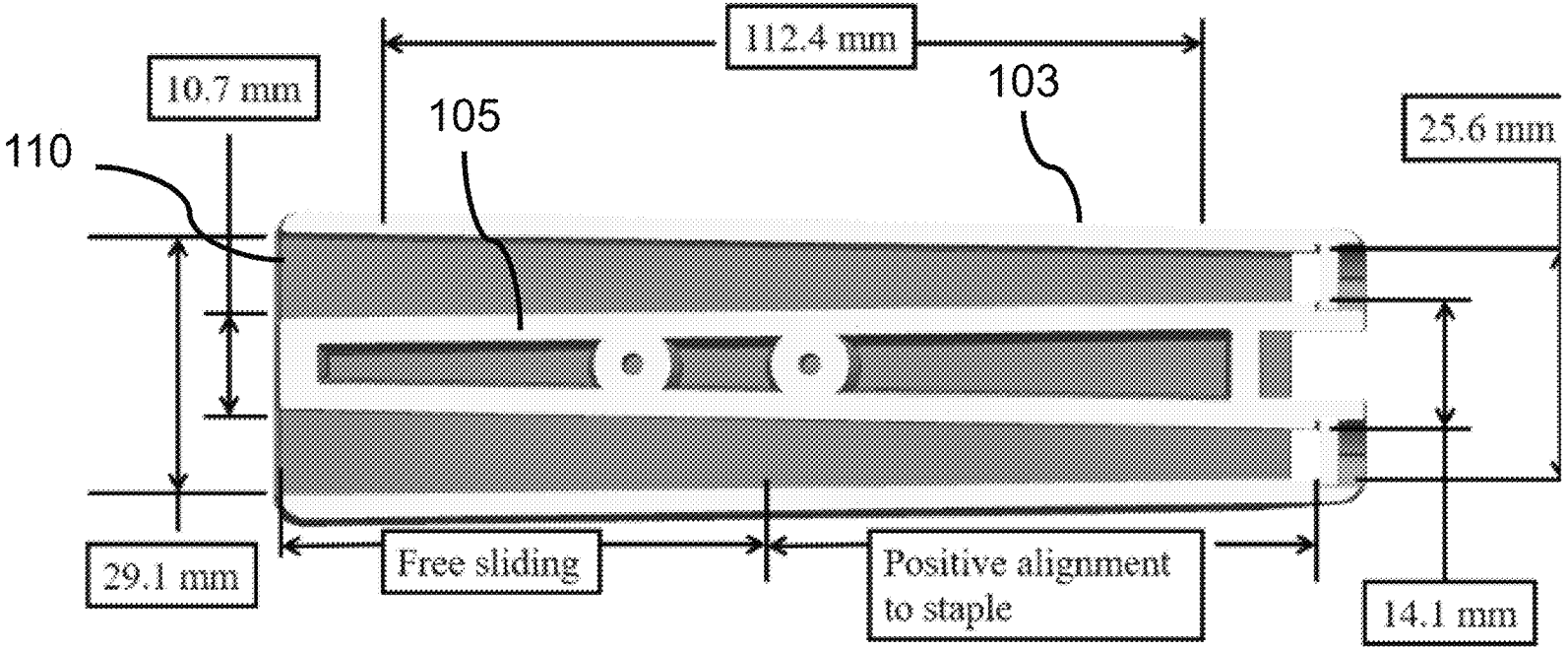
FIG. 7 is a side plan view of the fastener holder and dispenser with reference axes shown and labeled that shows certain inner dimensions of the fastener holder and dispenser.
Figure 19:
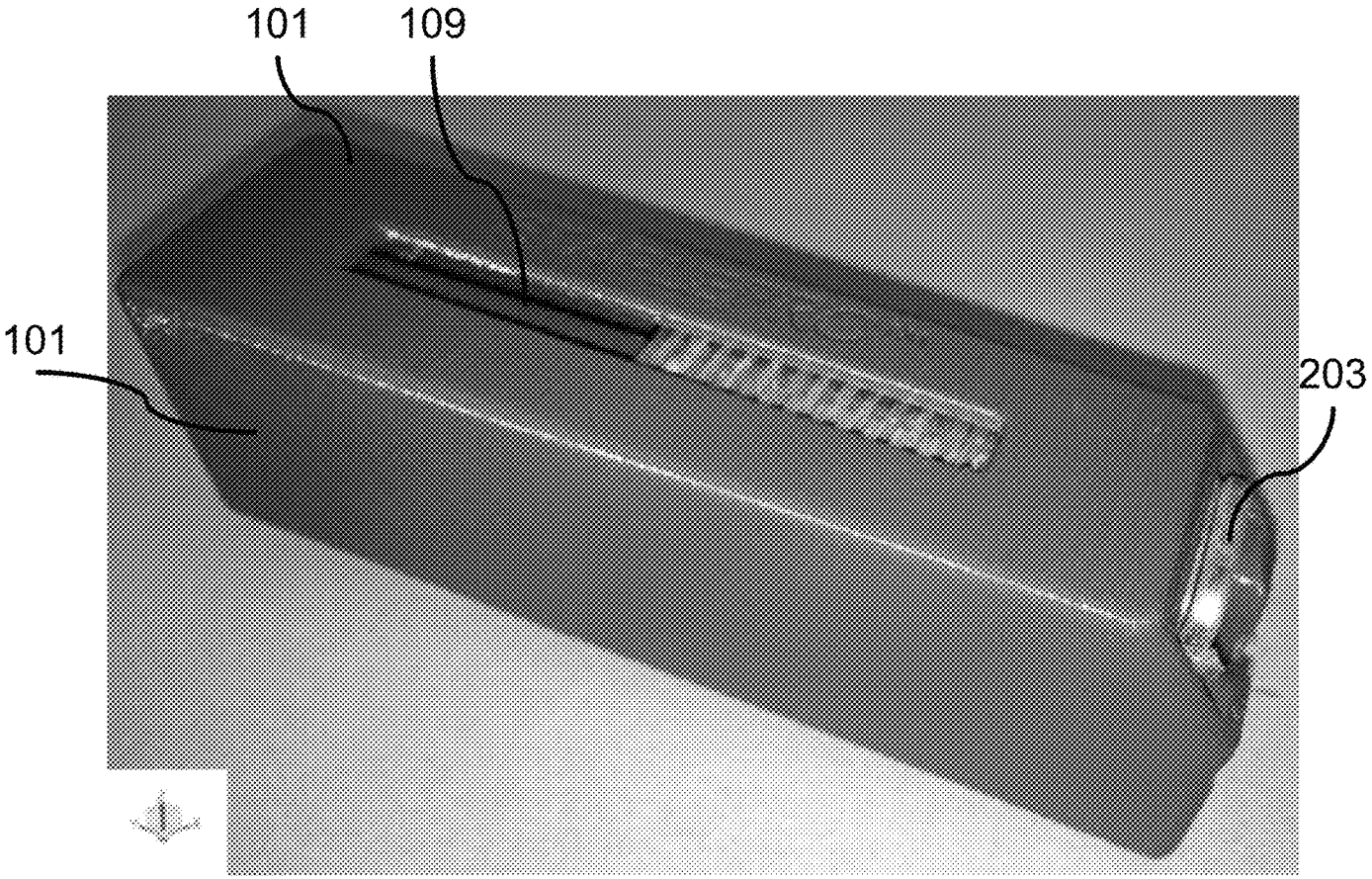
FIG. 19 is a side left perspective view of a prototype fastener holder and dispenser with reference axes shown and labeled.

Embodiments include a dispensing slot from which a fastener may be removed, and one or more magnets to provide sufficient force to maintain at least a lead staple in the desired position prior to extraction, as shown in FIG. 19. The front wall 101 and the bottom wall 104 define a dispensing slot 106 at the bottom of the fastener holder and dispenser where the front wall 101 and the bottom wall 104 meet, as is shown in FIG. 2 and FIG. 6. In some embodiments, the fastener rail 105 may be tapered such that it is narrower at the section nearest the top wall 110 to promote easier loading of fastener core 201, and wider at the section nearest the bottom wall 104 to prevent x-y plane movement or rotation of the fasteners, as is shown in FIG. 7 and FIG. 9. Unlike prior art designs, the tapered fastener rail 105 advantageously allows a user to quickly load a fastener core into the top wall 110, and then the apparatus aligns the core 201 as the core 201 approaches the bottom wall. The fastener holder and dispenser may comprise at least one magnet 107 affixed to the partially open bottom wall 104, as is shown in FIG. 2, FIG. 12, FIG. 13, and FIG. 20.

Figure 21B:
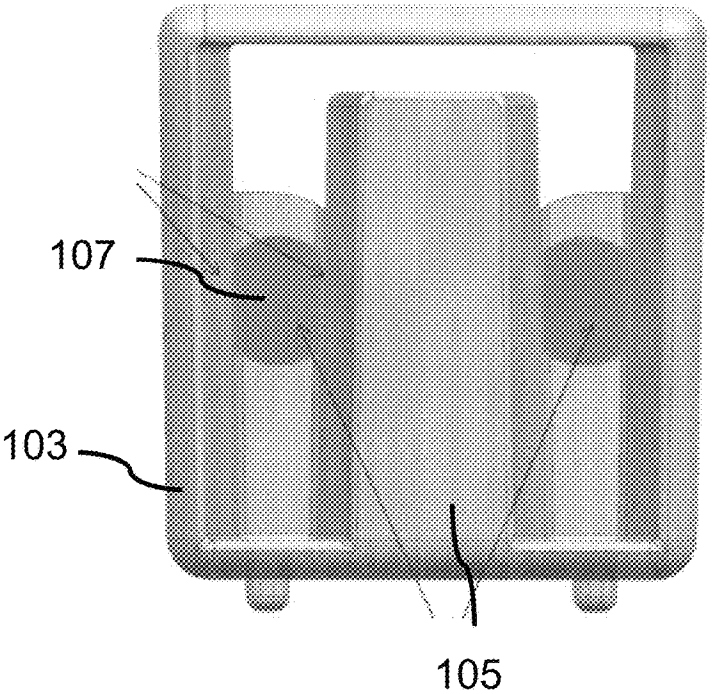
FIG. 21A-B provide bottom and top plan views, respectively, of the fastener holder and dispenser with magnets shown.
Figure 21A:
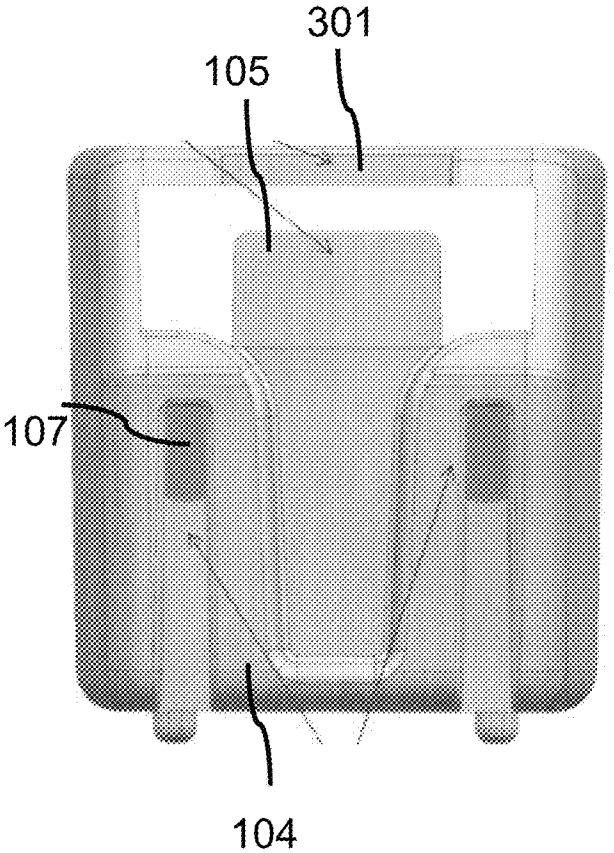
Figure 22:
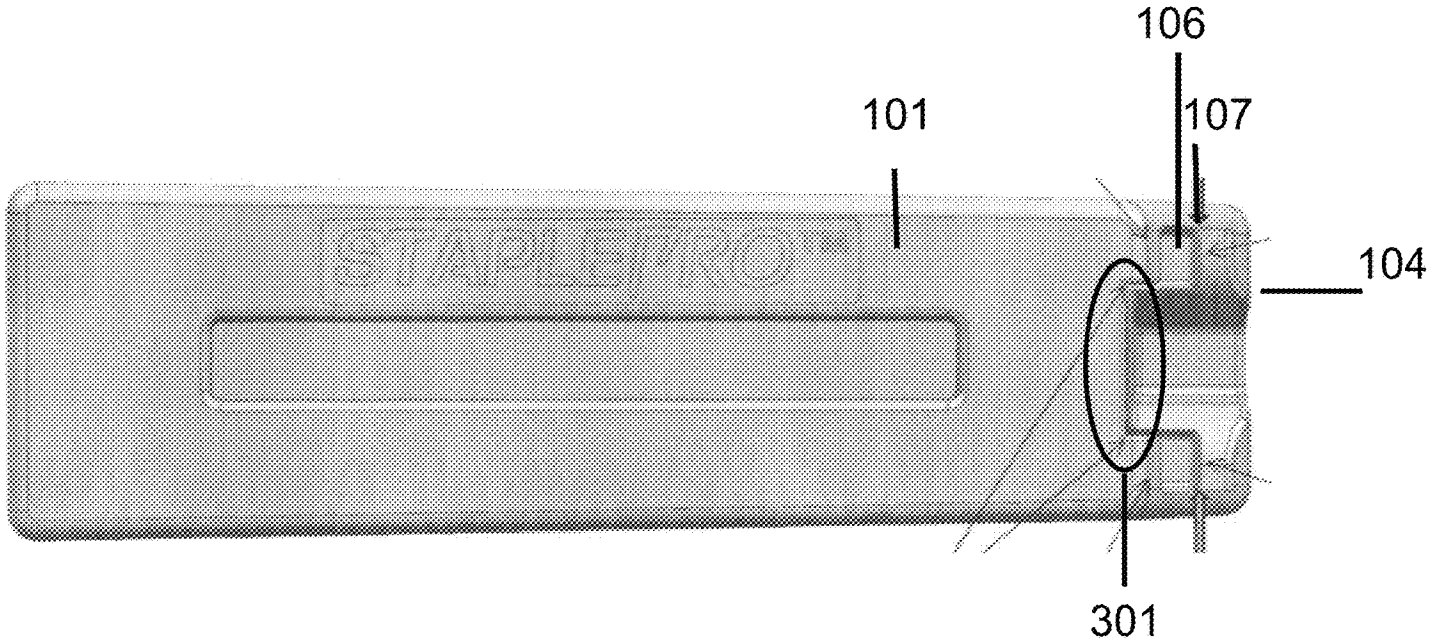
FIG. 22 is a top plan view of a portion of the fastener holder and stapler that shows certain dimensions associated with the dispensing slot.

It should be appreciated that a variety of magnet sizes and shapes may be used under the present approach. It should also be appreciated that the bottom wall of an embodiment may be configured for retaining magnets in a beneficial manner. For example, FIGS. 21A and 21B show that the magnets 107 may be encapsulated into the bottom wall 104 of the fastener holder and dispenser. Magnets 107 may be round, and inserted into cavities such that a portion of the magnet is exposed to the ambient. In this manner, the structure of bottom wall 104 retains the magnets 107 in position, and exposes adequate surface area to provide sufficient magnetic force. For example, in a preferred embodiment, the magnets 107 protrude about 0.5 mm past the bottom wall 104 towards the dispensing slot 106, as shown in FIG. 22. FIG. 21B shows that the magnets 107 may be wider than the space between the side wall 103 and the fastener rail 105. Such configurations may beneficially prevent the magnets 107 from moving into the body of the fastener holder and dispenser. FIG. 21A shows an embodiment in which the partially open bottom wall 104 may hold the magnets 107 in place during manufacturing. FIGS. 21A, 21B, and 22 also show that the front wall 101 may include an ejection notch 301 that is configured to be the same depth as fastener rail 105 to simplify the manufacturing process and facilitate easier removal of staples.

It should be appreciated that the size and shape of the magnet may vary, and that persons of ordinary skill should consider the type of fastener when selecting the one or more magnet. Also, though embodiments disclosed herein show at least one magnet 107 located on bottom wall 104, other embodiments may locate one or more magnets along a bottom portion of an interior wall. Further, in other embodiments, other interior tensioning devices may be used to ensure that the core of fasteners 201 is received and held in place so that each lead fastener 203, as the prior lead fastener 203 is removed, rests on or adjacent to the bottom wall 104, as shown in FIG. 19.

Figure 3:
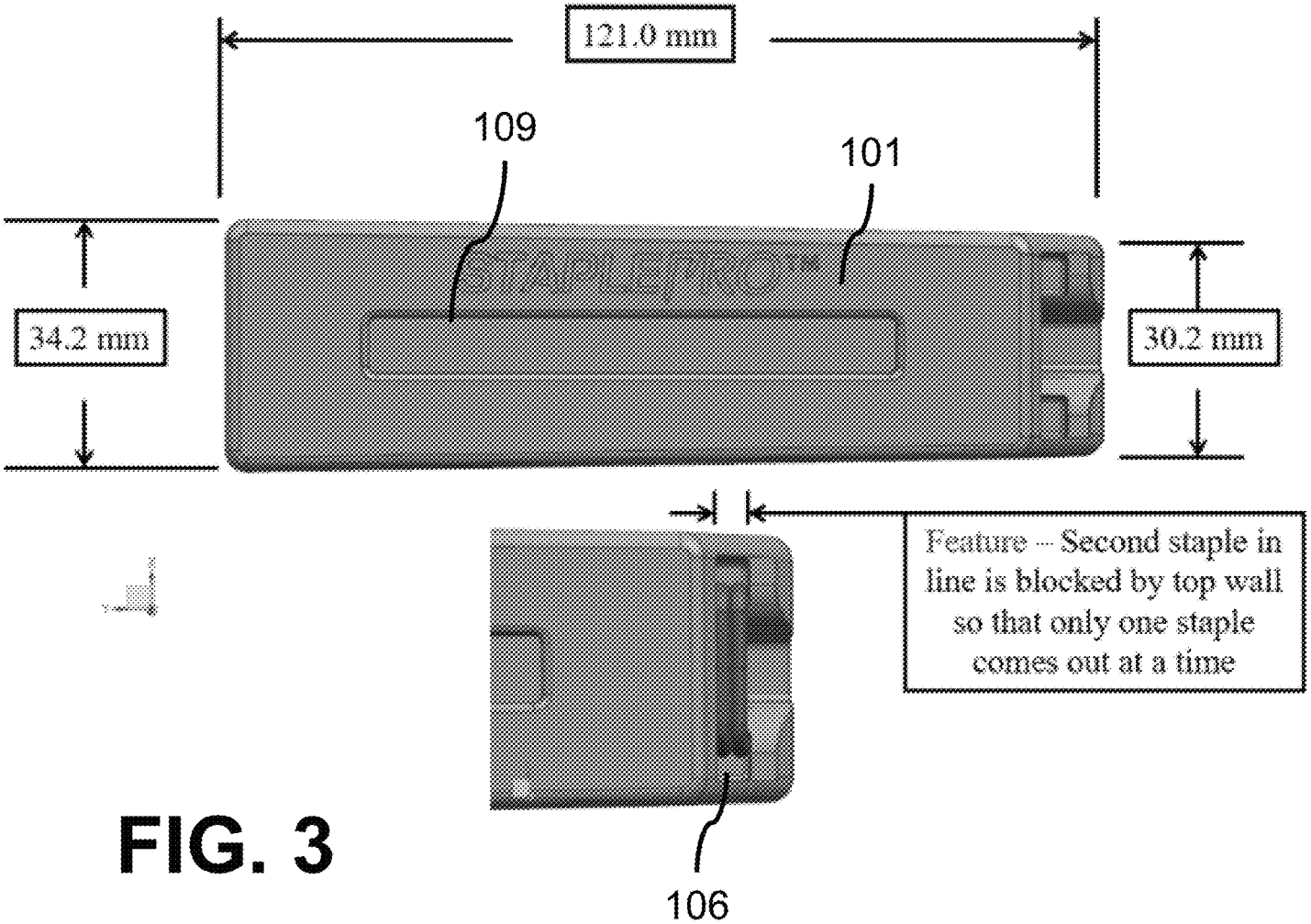
FIG. 3 is a front plan view of the fastener holder with reference axes shown and labeled, showing certain exterior dimensions of the holder and dispenser.
Figure 4:
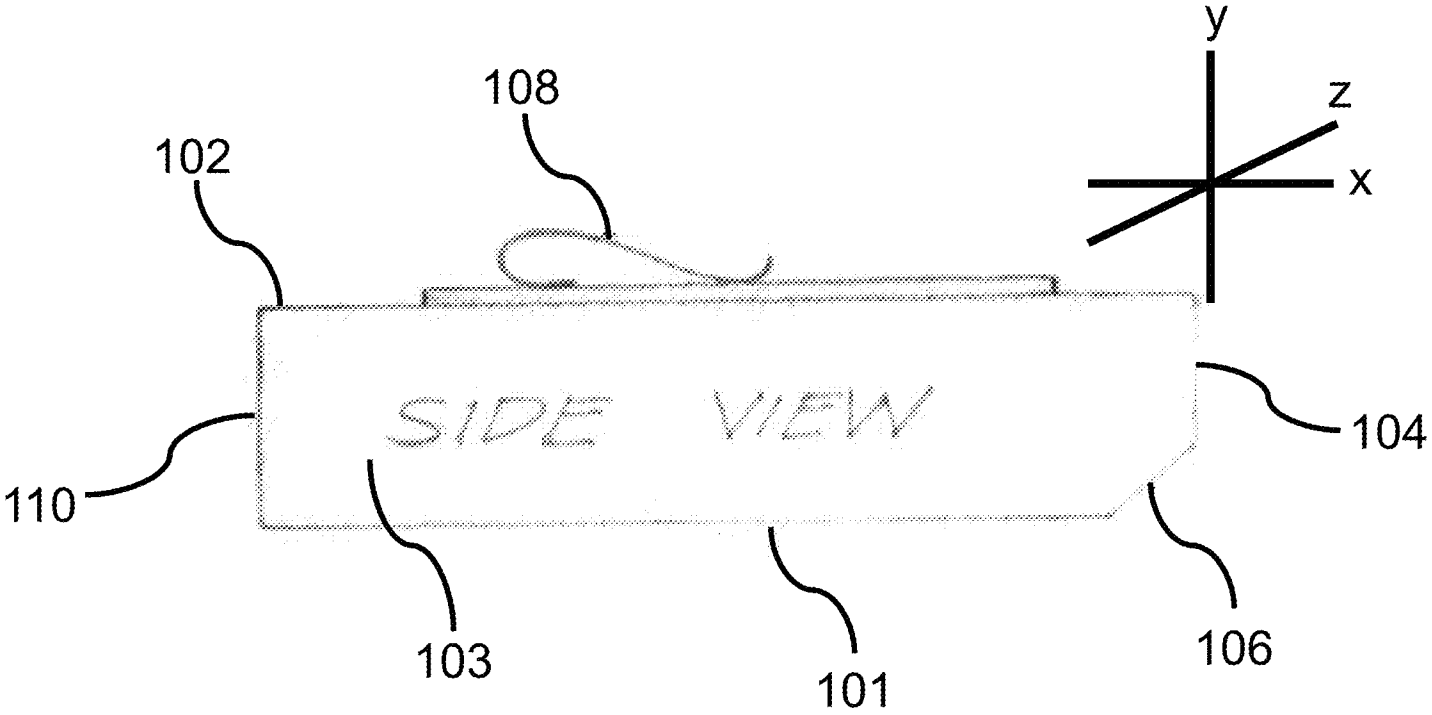
FIG. 4 is a side plan view of the fastener holder and dispenser with reference axes shown and labeled.
Figure 5:
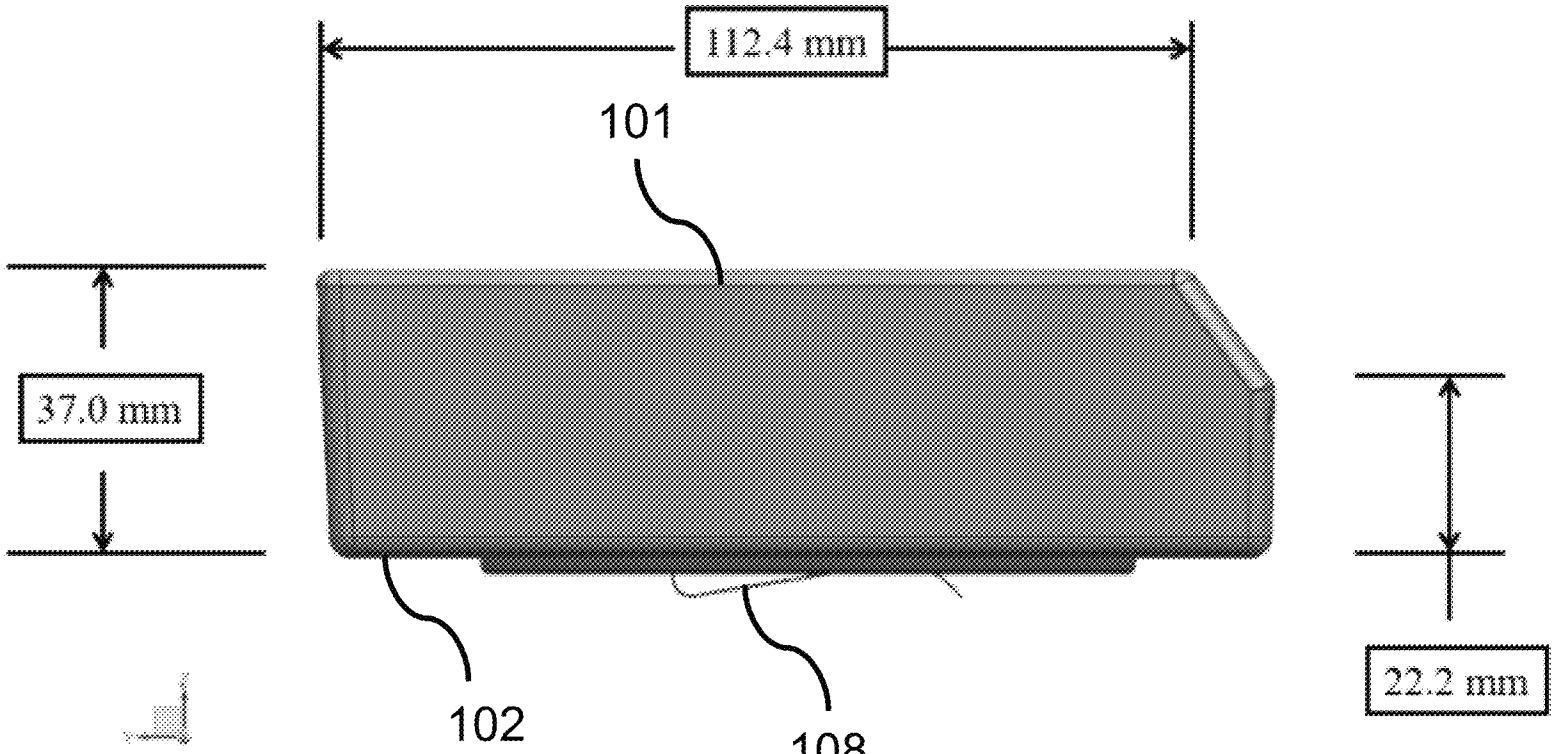
FIG. 5 is a side plan view of the fastener holder and dispenser with reference axes shown and labeled that shows certain outer dimensions of the fastener holder and dispenser.

In an exemplar embodiment, the dimensions of the fastener holder and dispenser are 121 mm long by 34.2 mm wide (at the widest point) by 37.0 mm high (at the highest point), as is shown in FIG. 3 and FIG. 5. It should be appreciated that other embodiments may employ different dimensions without departing from the scope of the present disclosure. In some embodiments, the fastener holder and dispenser may be formed as a single unit via an injection molding process. In other embodiments the various surfaces and components may be connected by fusing material, or using other methods of connecting separate parts as may be known in the art. In one embodiment, the fastener holder and dispenser may comprise a belt clip 108 affixed to the back wall 102, as is shown in FIG. 4 and FIG. 5. The belt clip 108 may be affixed in any manner of ways as may be known in the art, such as, for example, one or more adhesives, interlocking structures, screws, pins, and the like. In some embodiments, the front wall 101 of the fastener holder and dispenser may comprise a window 109 for viewing the supply of fasteners.

Figure 8:
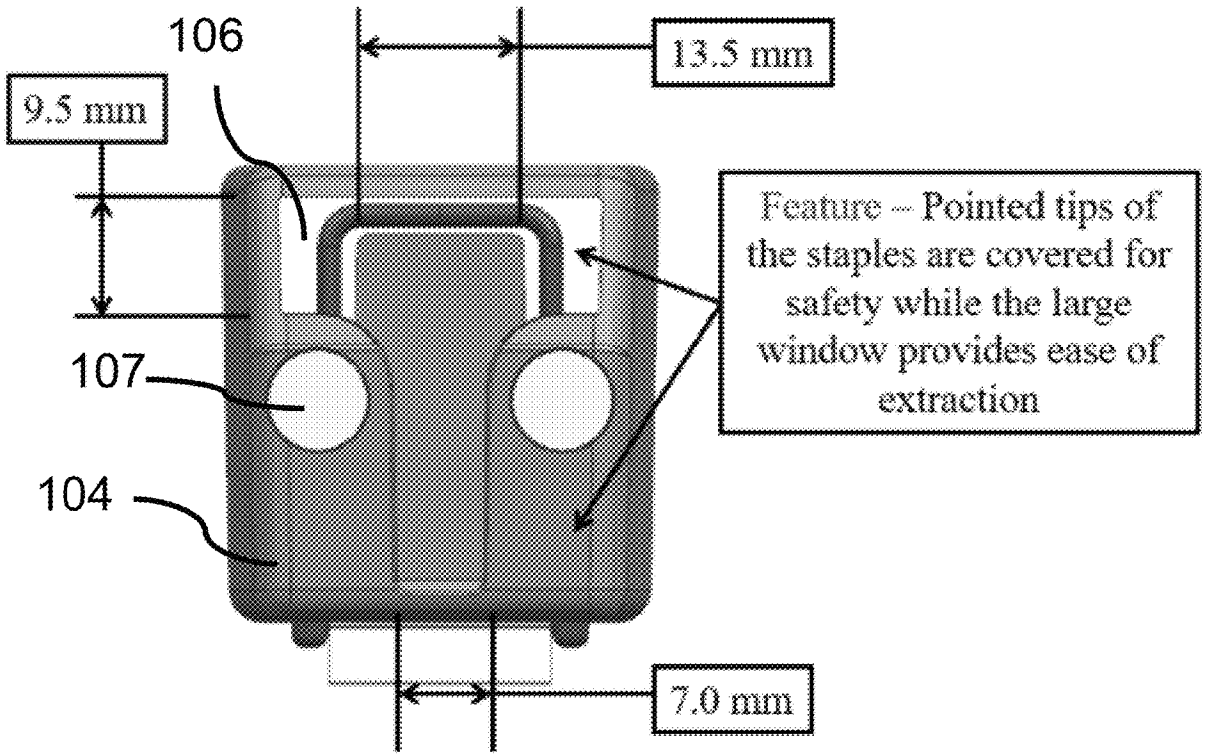
FIG. 8 is a bottom plan view of the fastener holder and dispenser marked to show certain dimensions of the holder and dispenser.
Figure 10:
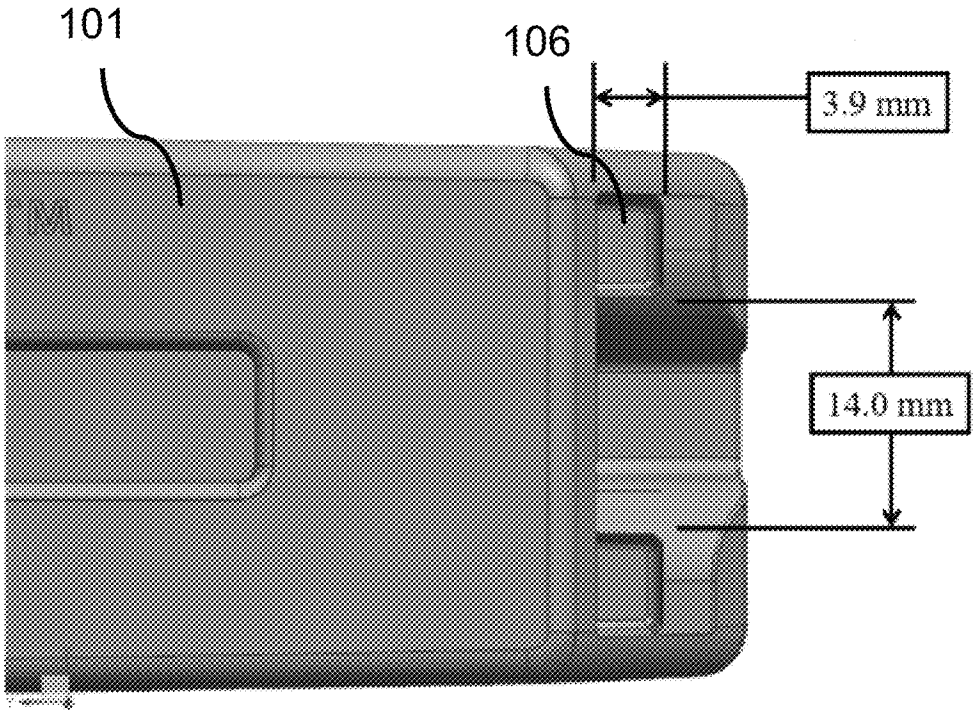
FIG. 10 is a top plan view of a portion of the fastener holder and stapler that shows certain dimensions associated with the dispensing slot.
Figure 11:
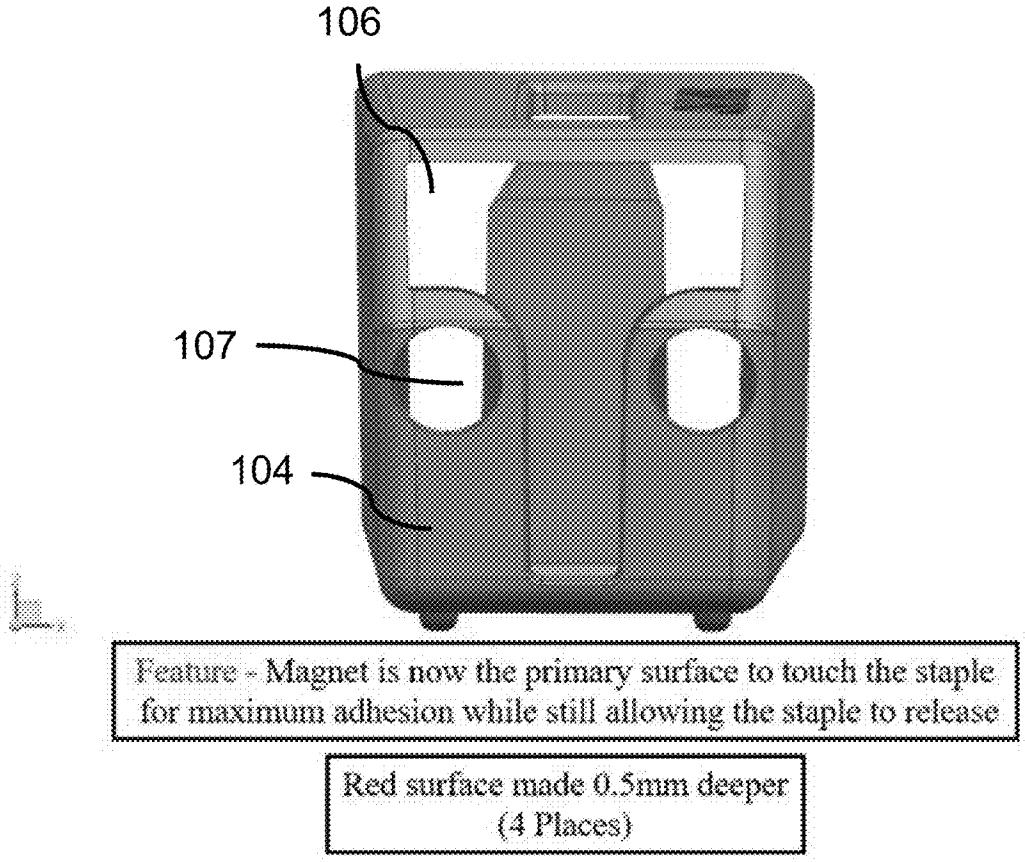
FIG. 11 is a bottom plan view of the fastener holder and dispenser, with magnets removed.
Figure 12:
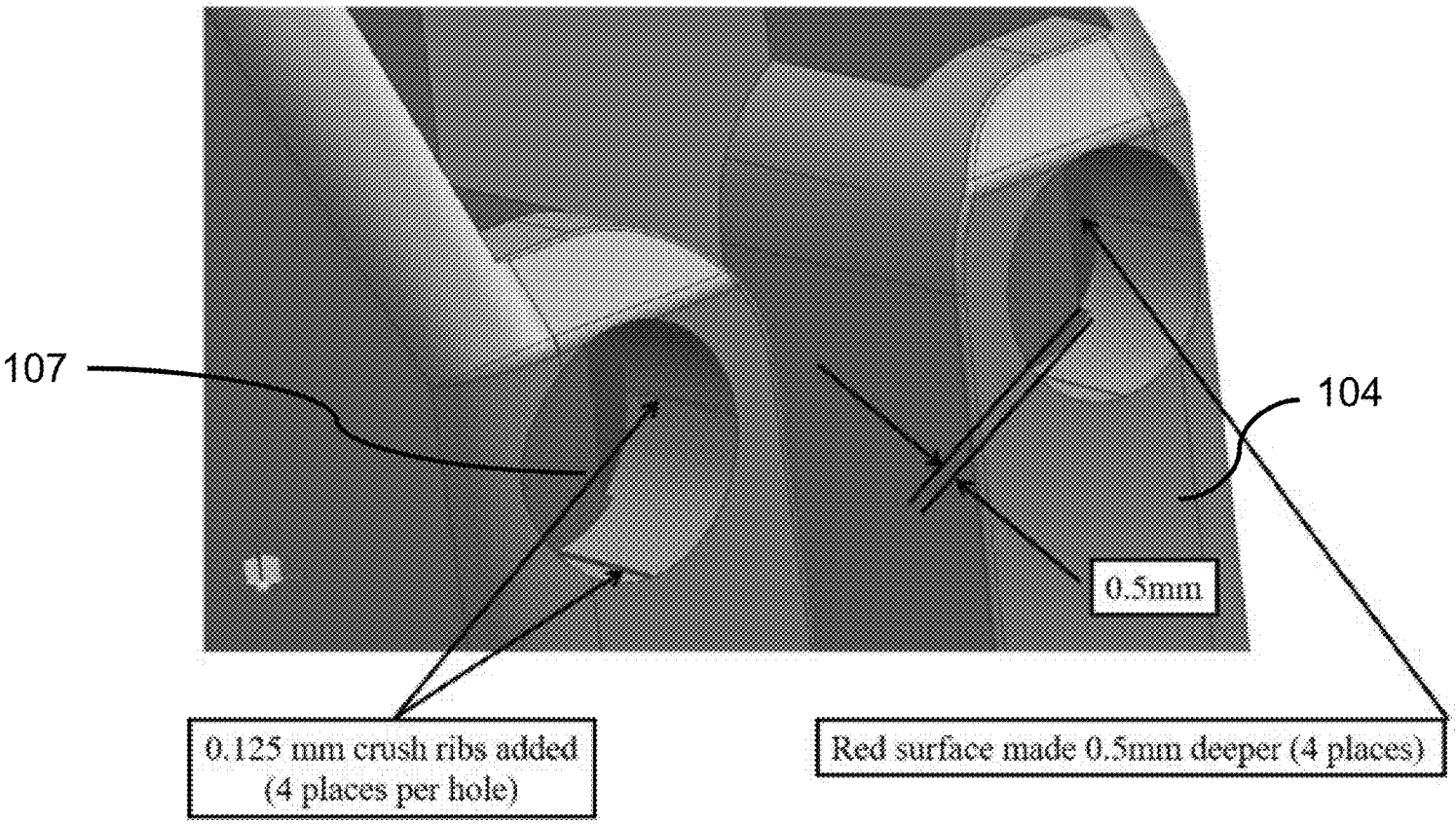
FIG. 12 is a bottom left perspective view of the fastener holder and dispenser that describes interior features of the fastener holder and dispensers associated with installation of the magnets.
Figure 13:
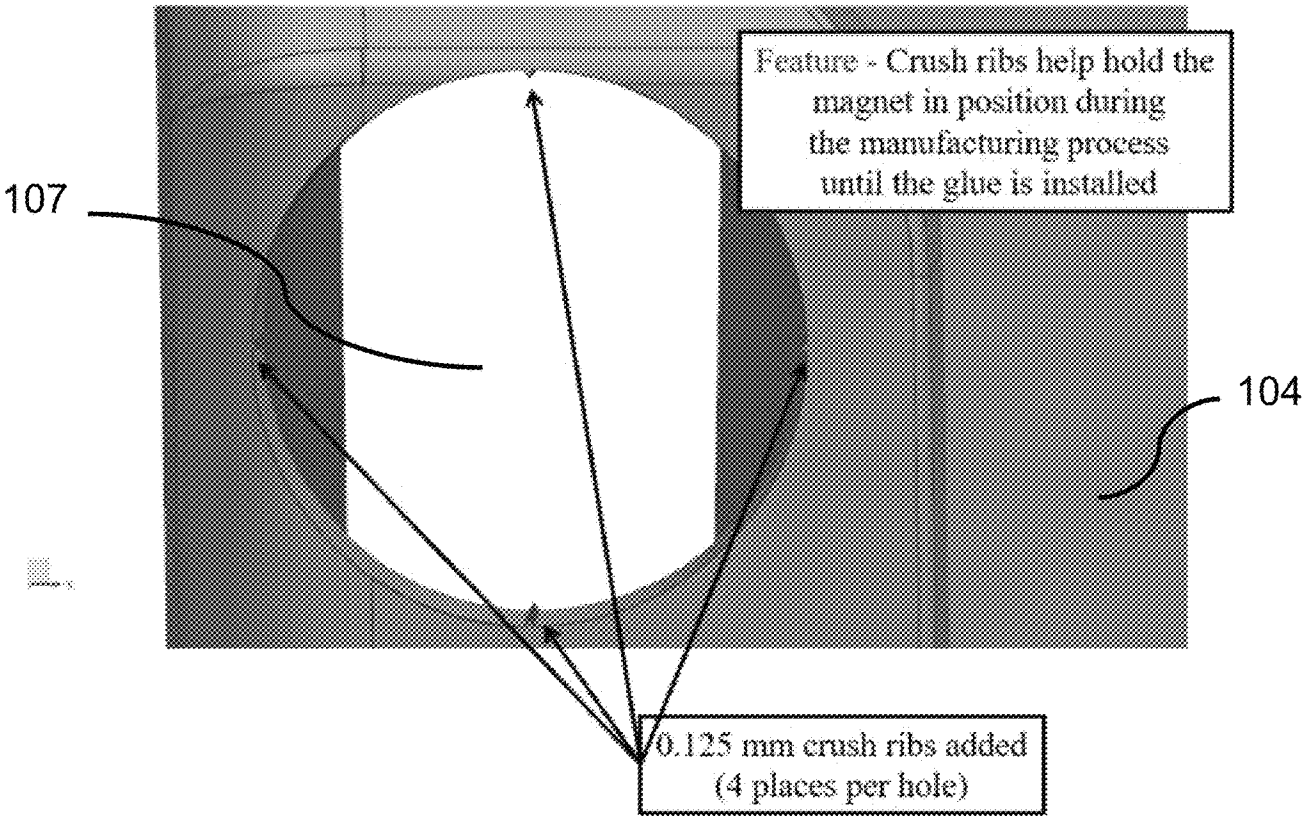
FIG. 13 is a bottom plan view of the fastener holder and dispenser that describes interior features of the fastener holder and dispensers associated with installation of the magnets.
Figure 14:
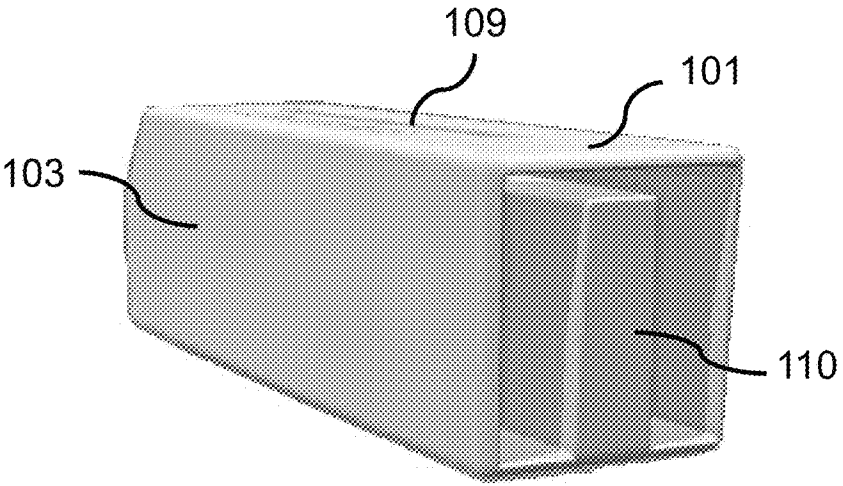
FIG. 14 is a top left perspective view of the fastener holder and dispenser.
Figure 20:
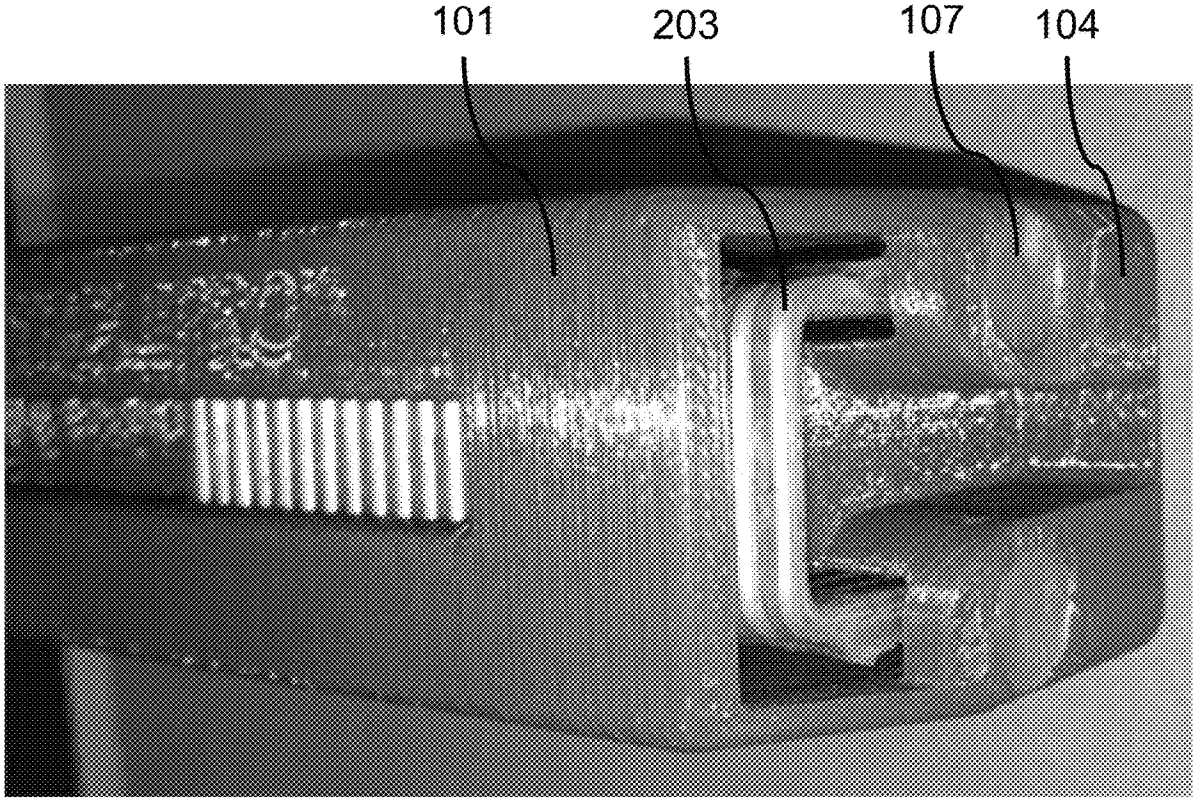
FIG. 20 is a left bottom perspective view of a prototype fastener holder and dispenser.

In some embodiments, the top wall 110 may be configured to receive a fastener core 201 as shown in FIG. 14. Other embodiments may allow a core 201 to be inserted through an opening or slot in a wall. Such embodiments may also include one or more magnets at locations other than at or near bottom wall 104, configured to keep the core 201 seated inside the apparatus. For example, a low-strength magnetic tape may be installed along an inner surface. Of course, such additional magnet(s) should be strong enough to prevent the core 201 from falling out of the opening or slot, yet weak enough to allow the core to descend toward the dispensing slot 106 as a user removes fasteners, and weak enough to not overcome the adhesive strength in a core 201 (causing the core to separate while in the apparatus). The fasteners in the fastener core 201 may be cohered together by an adhesive means 202 on one or more surfaces of the fasteners, among other methods, such as glue, silicon, or tape, as may be known in the art to hold individual fasteners together in a core. It will also be understood that fasteners may be detachably cohered in cores using insulation materials, through the use of release tabs or similar means. In some embodiments, the fastener holder and dispenser may comprise two magnets 107 affixed to opposing sides of the bottom wall 104. The magnet(s) 107 are preferably of sufficient strength to hold the lead fastener 203 and the remaining attached fastener core 201 in place, but not so strong so as to inhibit the removal of the lead fastener 203 by a user. It should be appreciated that the one or more magnets 107 overcomes the design limitation found in prior art devices, such as in the device of U.S. Pat. No. 2,436,577, because the one or more magnets 107 eliminate the need for elements, such as cam 36 (which is required to prevent accidental or unintentional displacement of the staples), that make retrieval of fasteners cumbersome. The one or more magnets 107 also eliminate the need for features such as caps at the top of the holder/dispenser, or apparatuses, such as spring loaded pusher mechanisms often found in staple guns or similar fastener installing tools, which make loading of fasteners more cumbersome. This is because the one of more magnets 107 may be configured to hold, not just the lead fastener 203 in place, but hold the whole core 201 in place due to the fact that the fasteners are cohered. The one or more magnets 107 allows for a partially open bottom wall 104 that makes retrieval of the fasteners easier, as is shown in FIG. 6 and FIG. 10. In some embodiments, two circular N42-neodymium magnets, having a diameter of 8 mm, a thickness of 2 mm, a pull strength of 4 lbs. 10 oz, and a surface gause of 2600 may be used. In some embodiments, the at least one magnet 107 is affixed to the bottom of back wall 102 and/or the side wall 103. In some embodiments, the at least one magnet 107 is configured to engage a lead fastener 203 of the fastener core 201 upon contact, as is shown in FIG. 8, FIG. 11 and FIG. 20. In some embodiments, the dispensing slot 106 is configured to reveal one fastener at a time, as is shown in FIG. 3 and FIG. 6. The dispensing slot 106 may be large enough to allow a user's finger or a device to contact at least a portion of lead fastener 203 and exert an outward force on that portion, sufficient to overcome the adhesive means 202 cohering the lead fastener 203 to the remainder of the core and the at least one magnet 107, and thereby extract lead fastener 203 from the fastener holder and dispenser. In the disclosed embodiment, the front wall 101 of the holder holds back the rest of the fastener core 201 behind the lead fastener 203 being retrieved, causing a sheering action while the lead fastener 203 is pulled on. In one embodiment, the dispensing slot 106 is configured to reveal a crown 204 of the fastener such that the crown 204 faces outward, as is shown in FIG. 3, FIG. 19, and FIG. 20. In some embodiments, front wall 101 may include one or more protrusions configured to create the sheering action against the lead fastener 203 but maintain subsequent fasteners in fastener core 201 in position. Upon extraction of lead fastener 203, gravity and/or the at least one magnet 107 cause the fastener core 201 to move towards partially open bottom wall 104, thereby revealing a new lead fastener 203 for extraction.

Individual fasteners for installation of electrical wire are well known to those in the electrical industry, and are available from a number of sources, such as King Manufacturing Ltd. (Canton, Ohio). Less popular, but also present in the market, are staple guns and staples that are used to install electrical wire. These employ cohered cores of staples similar to those used in the present disclosure. These staple guns and staples are also available in the market through sources such as Arrow Fastener Co., LLC (Saddle Brook, N.J.) and Acme Staple Co. (Franklin, N.H.). Staples may also incorporate plastic or paper insulators which are interposed between the crown of the metal staples and the electrical wire to inhibit compromise by the staple of the plastic surface that protects the interior electrical conducting material of the electrical wire.

Figure 15A:
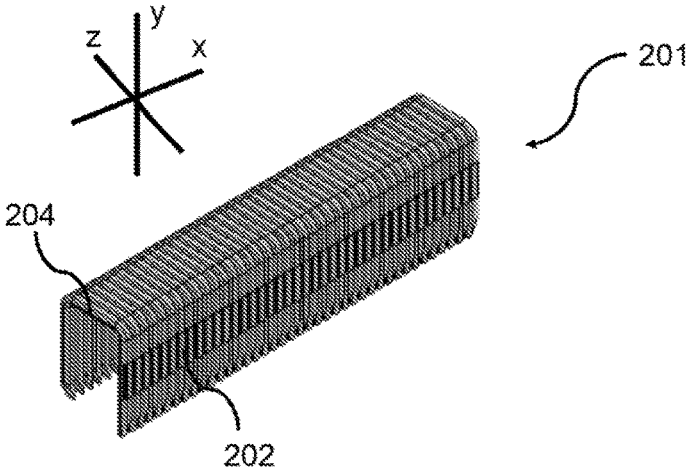
FIG. 15A-B provide front left and side perspective views of a fastener core with reference axes shown and labeled.
Figure 15B:
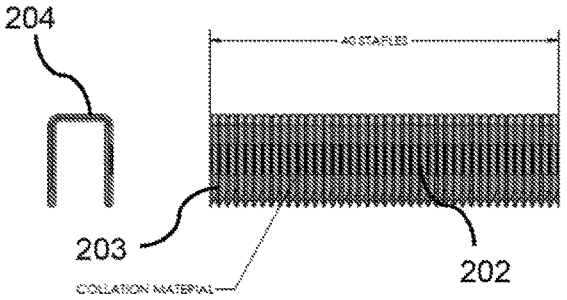
Figure 16B:
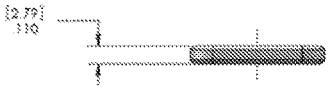
FIG. 16A-C provide front, top, and side perspective views of a lead staple.
Figure 16A:
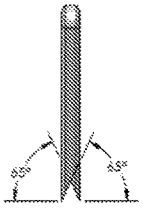
Figure 16C:
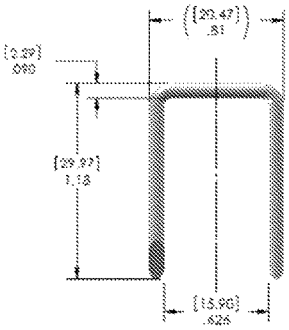

Typically, NM-B wire (Non Metallic, B temperature rated wire, commonly referred to as ROMEX®) is essentially rectangular in shape, and the staples that are used to install it are shaped to conform to the shape and dimensions of the wires so as to promote installation of the staple over the wire in a congruent fashion. Almost universally, and as shown in FIG. 15, both individual and cohered staples have ends which are tapered to sharp points, in opposite directions on opposing legs of the staple (known in the industry as divergent points, because these opposing tapered points cause the staple ends to diverge in the substrate (typically wood) when installed, thereby increasing the force needed to extract the staple (also known as holding power.)) Typically, all or a portion of the wire used to make the staple, and particularly the crown portion, is flattened to promote ease of installation using a hammer. It is a strength of the present disclosure that it employs staples which are configured in a substantially standard manner for both means of application, are cohered similar to staples used for staple gun application, but allows for individual dispensing and installation of these staples, which is by far the preferred method of application among electricians.

In some embodiments, the fasteners are cohered in cores of between 40 and 50 fasteners, as is shown in FIG. 15. In some embodiments of the present invention, the fasteners may comprise galvanized steel wire with a tensile strength of 170-200 KPSI, with a width of 20.47 mm, a height of 29.97 mm, and a thickness of 2.79 mm. The inner dimensions of the legs and crown of the staple are shaped and dimensioned to conform to the dimensions of standard electrical wires, with the sufficient leg length so that, once installed over the wire, holding power conforms to industry standard, as typically enunciated by organizations such as UL. In such embodiment, a point angle of 65 degrees has been found to be suitable. In another embodiment of the present invention, one leg of the fastener may be slightly longer than the other to allow this longer portion to be installed into the substrate with a slight blow of the hammer, thereby holding it in place and allowing the installer to remove his fingers prior to full installation.

The present disclosure provides a method of holding fasteners in a fastener holder and dispenser. The method comprises providing a front wall 101, a back wall 102, two opposing side walls 103, an open top wall 110, and a partially open bottom wall 104 such that, when assembled, form an elongated housing having a height along a y-axis, a width along an x-axis, and a length along a z-axis; wherein the front wall 101 and back wall 102 are configured to extend along an x-y plane; wherein the two opposing side walls 103 are configured to extend along a y-z plane; wherein the open top wall 110 and the partially open bottom wall 104 are configured to extend along an x-z plane; wherein a fastener rail 105 extends the length of the elongated housing, the fastener rail 105 being fixedly attached to an inside surface of the back wall 102 and being shaped at a front to conform to the shape of the fasteners; wherein the front wall 101 defines a dispensing slot 106 at the bottom of the front wall 101; wherein the dispensing slot 106 is configured to allow removal of one fastener at a time; and wherein the fastener holder and dispenser may comprise at least one magnet 107 affixed to the partially open bottom wall 104; and placing a fastener core 201 through the open top wall 110 into the elongated housing.

The present disclosure also provides a method of dispensing fasteners from a fastener holder and dispenser. The method comprises providing a front wall 101, a back wall 102, two opposing side walls 103, an open top wall 110, and a partially open bottom wall 104 such that, when assembled, form an elongated housing having a height along a y-axis, a width along an x-axis, and a length along a z-axis; wherein the front wall 101 and back wall 102 are configured to extend along an x-y plane; wherein the two opposing side walls 103 are configured to extend along a y-z plane; wherein the open top wall 110 and the partially open bottom wall 104 are configured to extend along an x-z plane; wherein a fastener rail 105 extends the length of the elongated housing, the fastener rail 105 being fixedly attached to an inside surface of the back wall 102 and being shaped at a front to conform to the shape of the fasteners; wherein the front wall 101 defines a dispensing slot 106 at the bottom of the front wall 101; and wherein the fastener holder and dispenser may comprise at least one magnet 107 affixed to the partially open bottom wall 104; placing a fastener core 201 through the open top wall 110 into the elongated housing; and inserting a finger into the partially open bottom wall 102 and pulling a fastener out through the dispensing slot 106. In one embodiment, the dispensing slot 106 is configured to permit one fastener to be pulled out at a time. In another embodiment, after a fastener is retrieved, the fastener core 201 drops onto the at least one magnet 107 and the process is repeated. The fastener core 201 drops onto the at least one magnet 107 because of gravity. This feature is different from conventional staple or nail guns or other fastener installation tools, which generally require a spring loading pusher mechanism to feed fasteners from a magazine into the path where they can be installed, typically with a drive blade which is raised and then fired through an electric or pneumatic powered, or levered and spring-tensioned handle, mechanism. The device of the present disclosure uses gravity and at least one magnet 107 to hold the fastener core 201 in place and therefore requires no such mechanisms to load the fastener in the dispensing slot 106 or lock it into for the dispensing slot 106 for dispensing. It is also notable that the present invention depicts a dispensing means, and not the installation means more typical in the industry. For a description of the mechanisms associated with a standard staple gun, see, for example, U.S. Pat. No. 8,322,010.

It will be understood that although the terms "first," "second," "third," "a)," "b)," and "c)," etc. may be used herein to describe various elements of the present approach should not be limited by these terms. These terms are only used to distinguish one element of the present approach from another. Thus, a first element discussed below could be termed a element aspect, and similarly, a third without departing from the teachings of the present approach. Thus, the terms "first," "second," "third," "a)," "b)," and "c)," etc. are not intended to necessarily convey a sequence or other hierarchy to the associated elements but are used for identification purposes only. The sequence of operations (or steps) is not limited to the order presented in the claims.

Unless otherwise defined, all terms (including technical and scientific terms) used herein have the same meaning as commonly understood by one of ordinary skill in the art to which this present approach belongs. It will be further understood that terms, such as those defined in commonly used dictionaries, should be interpreted as having a meaning that is consistent with their meaning in the context of the present application and relevant art and should not be interpreted in an idealized or overly formal sense unless expressly so defined herein. The terminology used in the description of the present approach herein is for the purpose of describing particular embodiments only and is not intended to be limiting of the present approach. All publications, patent applications, patents and other references mentioned herein are incorporated by reference in their entirety. In case of a conflict in terminology, the present specification is controlling.

Also, as used herein, "and/or" refers to and encompasses any and all possible combinations of one or more of the associated listed items, as well as the lack of combinations when interpreted in the alternative ("or").

Unless the context indicates otherwise, it is specifically intended that the various features of the present approach described herein can be used in any combination. Moreover, the present approach also contemplates that in some embodiments of the present approach, any feature or combination of features set forth herein can be excluded or omitted. To illustrate, if the specification states that a complex comprises components A, B and C, it is specifically intended that any of A, B or C, or a combination thereof, can be omitted and disclaimed.

As used herein, the transitional phrase "consisting essentially of" (and grammatical variants) is to be interpreted as encompassing the recited materials or steps "and those that do not materially affect the basic and novel characteristic(s)" of the claimed present approach. Thus, the term "consisting essentially of" as used herein should not be interpreted as equivalent to "comprising."

The term "about," as used herein when referring to a measurable value, such as, for example, an amount or concentration and the like, is meant to encompass variations of ±20%, ±10%, ±5%, ±1%, ±0.5%, or even ±0.1% of the specified amount. A range provided herein for a measurable value may include any other range and/or individual value therein.

Having thus described certain embodiments of the present approach, it is to be understood that the present approach defined by the appended claims is not to be limited by particular details set forth in the above description as many apparent variations thereof are possible without departing from the spirit or scope thereof as hereinafter claimed.

What is claimed is:

1. A fastener holder and dispenser, the fastener holder and dispenser comprising:

a front wall, a back wall, opposing side walls, an open top wall, and a partially open bottom wall such that, when assembled, form an elongated housing having a height along a y-axis, a width along an x-axis, and a thickness along a z-axis;

wherein the front wall and back wall are configured to extend along an x-y plane;

wherein the opposing side walls are configured to extend along a y-z plane;

wherein the open top wall and the partially open bottom wall are configured to extend along an x-z plane;

wherein a fastener rail extends the length of the elongated housing, the fastener rail being fixedly attached to an inside surface of the back wall and being shaped at a front to conform to the shape of the fasteners;

wherein the front wall defines a dispensing slot at the bottom of the front wall; and wherein the fastener holder and dispenser comprises at least one magnet affixed to the partially open bottom wall; and wherein the fastener rail is tapered such that it is narrower at the section nearest the top wall and wider at the section nearest the bottom wall.

2. The fastener holder and dispenser of claim 1, wherein a belt clip is affixed to the back wall.

3. The fastener holder and dispenser of claim 1, wherein the front wall comprises a window therein for viewing supply of the fasteners.

4. The fastener holder and dispenser of claim 1, wherein the top wall is configured to receive a fastener core.

5. The fastener holder and dispenser of claim 1, wherein the fastener holder and dispenser comprises two magnets affixed to opposing ends of the bottom wall.

6. The fastener holder and dispenser of claim 1, wherein the at least one magnet is configured to engage a lead fastener of the fastener core upon contact.

7. The fastener holder and dispenser of claim 1, wherein the dispensing slot is configured to reveal one fastener at a time.

8. The fastener holder and dispenser of claim 1, wherein the dispensing slot is configured to reveal a crown of the fastener, wherein the crown faces outward.

9. The fastener holder and dispenser of claim 1, wherein the at least one magnet is encapsulated into the bottom wall.

10. The fastener holder and dispenser of claim 1, wherein the at least one magnet protrudes a distance of about 0.5 mm from the bottom wall.

11. The fastener holder and dispenser of claim 1, wherein the at least one magnet is wider than a space between the side wall and the fastener rail.

12. The fastener holder and dispenser of claim 1, wherein the front wall further comprises an ejection notch, wherein the ejection notch is the same depth as the fastener rail.

13. A method of holding fasteners in a fastener holder and dispenser comprising:

providing a front wall, a back wall, two opposing side walls, an open top wall, and a partially open bottom wall such that, when assembled, form an elongated housing having a height along a y-axis, a width along an x-axis, and a thickness along a z-axis;

wherein the front wall and back wall are configured to extend along an x-y plane;

wherein the two opposing side walls are configured to extend along a y-z plane;

wherein the open top wall and the partially open bottom wall are configured to extend along an x-z plane;

wherein a fastener rail extends the length of the elongated housing, the fastener rail being fixedly attached to an inside surface of the back wall and being shaped at a front to conform to the shape of the fasteners;

wherein the front wall defines a dispensing slot at the bottom of the front wall; and wherein the fastener holder and dispenser comprises at least one magnet affixed to the partially open bottom wall;

wherein the fastener rail is tapered such that it is narrower at the section nearest the top wall and wider at the section nearest the bottom wall; and placing a fastener core through the open top wall into the elongated housing.

14. A method of dispensing fasteners comprising:

providing a front wall, a back wall, two opposing side walls, an open top wall, and a partially open bottom wall such that, when assembled, form an elongated housing having a height along a y-axis, a width along an x-axis, and a thickness along a z-axis;

wherein the front wall and back wall are configured to extend along an x-y plane;

wherein the two opposing side walls are configured to extend along a y-z plane;

wherein the open top wall and the partially open bottom wall are configured to extend along an x-z plane;

wherein a fastener rail extends the length of the elongated housing, the fastener rail being fixedly attached to an inside surface of the back wall and being shaped at a front to conform to the shape of the fasteners;

wherein the front wall defines a dispensing slot at the bottom of the front wall; and wherein the fastener holder and dispenser comprises at least one magnet affixed to the partially open bottom wall;

wherein the fastener rail is tapered such that it is narrower at the section nearest the top wall and wider at the section nearest the bottom wall;

placing a fastener core through the open top wall into the elongated housing; and inserting a user's finger into the partially open bottom wall and pulling a fastener out through the dispensing slot.

15. The method of claim 14, wherein the dispensing slot is configured to permit one fastener to be pulled out at a time.

16. The method of claim 14, wherein after a fastener is retrieved the fastener core drops onto the at least one magnet.

* * * * *